US005601455A

United States Patent [19]

Bagga

[11] Patent Number: 5,601,455

[45] Date of Patent: Feb. 11, 1997

[54] QUADRIPLEX RECEPTACLE

[76] Inventor: Harcharan S. Bagga, 2227 Eastchester Rd., Bronx, N.Y. 10467

[21] Appl. No.: 385,297

[22] Filed: Feb. 10, 1995

[51] Int. Cl.[6] ..... H01R 25/00

[52] U.S. Cl. ..... 439/650

[58] Field of Search ..... 439/650, 652, 439/654, 105, 107

[56] References Cited

U.S. PATENT DOCUMENTS 4,583,799 4/1986 Wiley ..... 439/652

5,460,542 10/1995 Castellani et al. ..... 439/650

*Primary Examiner*—Khiem Nguyen

*Assistant Examiner*—Yong Kim

*Attorney, Agent, or Firm*—Paul J. Sutton, Esq.

[57] ABSTRACT

A quadruplex receptacle where all four receptacles can be connected in common to a single electrical cable or by severing the connecting links on its line bus it can be divided into two duplex receptacles each fed by a single cable. A feed-through arrangement can be used with either arrangement of the line bus. The neutral bus surrounds the line bus, both supported and electrically insulated from one another by a series of tabs and columns in the cavity within a housing. A ground bus extending into the cavity from a rear cover provides an isolated ground. Mounting apertures in the housing and cover permit mounting to a support surface, to a standard gang gem outlet box, or by means of an adapter plate to a number of mounting devices. A box can be placed about the cover to provide a portable device.

26 Claims, 9 Drawing Sheets

QUADRIPLEX RECEPTACLE

BACKGROUND OF THE INVENTION

1. Field of the Invention

The invention is directed to a quadriplex receptacle and more particularly to a quadriplex receptacle which can be used as a single unit or divided into two duplex receptacles and which can be mounted to a support surface directly or through an adapter or made into a floor unit by adding a back.

2. Description of Prior Art

According to the known prior art, in order to form a quadriplex receptacle it is necessary to use two duplex receptacles, each placed in one of two, side by side single gang gem boxes or in an enlarged box which can accept two duplex receptacles side by side. The four receptacles need to be wired in order that they function as a multi-receptacle. A multi-aperture face plate can be used to cover the box or boxes but there is no adapter to permit the two duplex receptacles to be mounted to surfaces other than two gang boxes or single enlarged box. To convert the two duplex receptacles to a portable device, it is necessary to mount the two duplex receptacles in an enlarged box and cover them with a multiple aperture wall plate.

SUMMARY OF THE INVENTION

The instant invention provides a quadriplex receptacle having four receptacles which can be wired to a single or multiple electrical conductors or separated into two duplex receptacles each coupled to one or more electrical conductors. The receptacles, either as a ganged unit or separated into two duplex receptacles, each provide an isolated ground. The quadriplex receptacle can be surface mounted, mounted over a variety of types of outlet boxes, mountable with or without an adapter plate to various surfaces or can be used as a portable device when assembled to a special back. It is an object of this invention to provide a quadriplex receptacle.

It is an object of this invention to provide a quadriplex receptacle which can be selectively separated into two duplex receptacles.

It is another object of this invention to provide a quadriplex receptacle which can be mounted on a single gang gem box.

It is still another object of this invention to provide a quadriplex receptacle which can be mounted upon several types of outlet boxes, and which can be mounted with or without an adapter plate or employed as a portable device with the addition of back.

Other object and features of the invention will be pointed out in the following description and claims and illustrated in the accompanying drawings, which disclose, by way of example, the principle of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
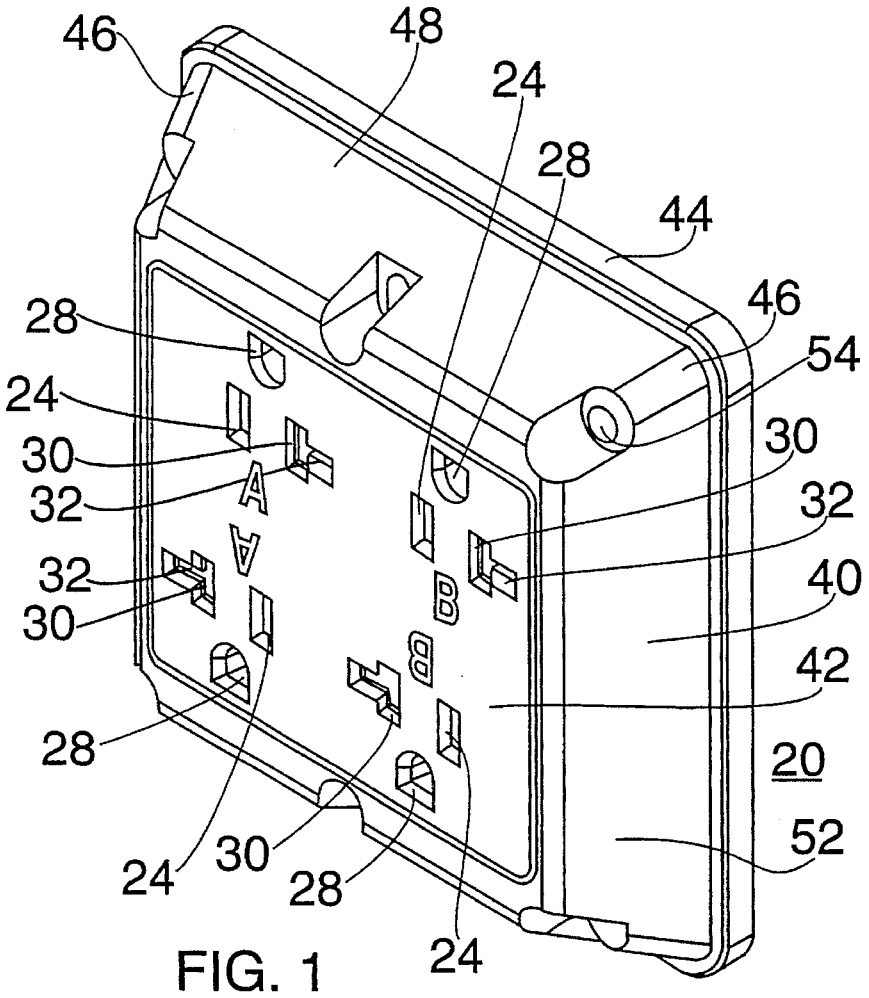
FIG. 1 is an isometric view of a quadriplex receptacle constructed in accordance with the concepts of the invention and shows a 20 Amp version.
Figure 4:
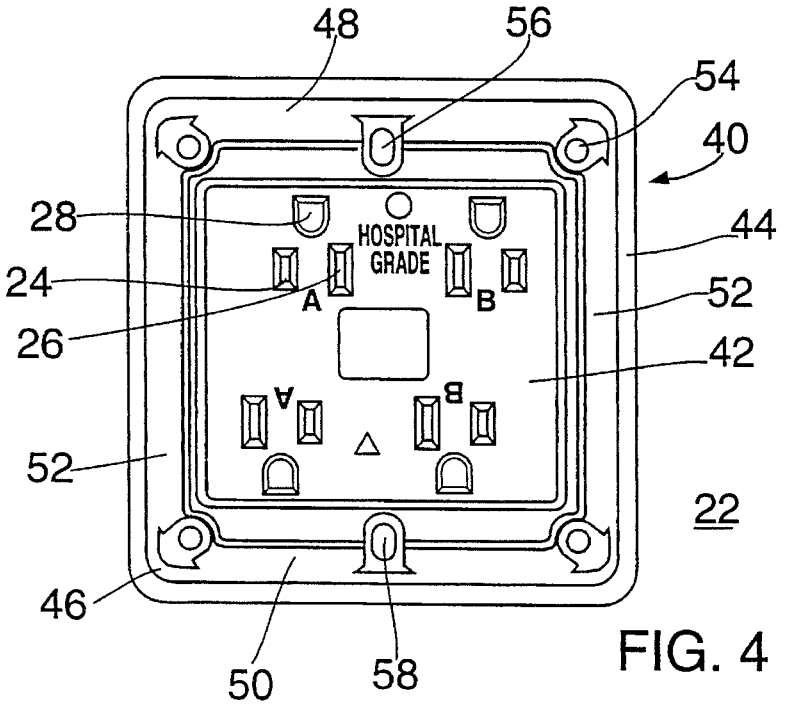
FIG. 4 is a front elevational view of a 15 Amp version of the quadriplex receptacle constructed in accordance with the concepts of the invention.

Turning now to FIGS. 1 to 4 there is shown a quadriplex receptacles 20 and 22 constructed in accordance with the concepts of the instant invention. Quadriplex receptacle 22 (see FIG. 4) is intended for 15 Amp, 125 VAC service and according to NEMA specification 5-15R has two flat blade openings 24 and 26 to receive the flat blades of a suitable plug (not shown). The opening 26 is larger that opening 24 so that a two blade plug can only be inserted in one way to maintain the correct electrical polarization. The larger slot 26 is connected to the white or neutral conductor and by maintaining the correct polarization, the external metal parts of appliances, TV's, etc. can be grounded through the white or neutral conductor. The same arrangement is also used where the plug has a semi-circular ground blade (not shown)

to enter the semi-circular opening 28, but the presence of the third blade makes insertion with the wrong polarity impossible.

The quadriplex receptacle 20 is intended for 20 Amp, 125 Volt service and has its openings arranged according to NEMA specification 5-20R. The opening 30 is larger than the opening 24 and the semicircular opening 28 is so positioned that a three blade plug (not shown) could be plugged in the same manner as it would be with receptacle 22 of FIG. 4. The difference is the side slot 32 extending from opening 30 which can accept the special 20 Amp plug (not shown). The 20 Amp plug has its white or neutral blade turned 90° with respect to the hot or black blade. This prevents the insertion of a 20 Amp plug into a 15 Amp receptacle and insures proper, polarized insertion of a 20 Amp plug into a 20 Amp receptacle. As will be described below the line or phase or hot and neutral contacts are constructed to accept flat blades in two perpendicular positions.

Quadriplex receptacle 20 has a truncated, pyramidal body 40 with a flat front surface 42 in which are placed the openings for four receptacles arranged to receive polarized three blade 20 Amp plugs (not shown). The two receptacles to the left of the center of FIG. 1 are designated A and the two receptacles to the right of file center of FIG. 1 are designated B.

A rib 44 extends about file entire periphery of body 40, and four edges 46 extend from rib 44 to from face 42 to define the top face 48, bottom face 50, and two side faces 52. An aperture 54 in each of the four edges 46 can receive a suitable fastener (not shown) to anchor body 40 to the adapter plate, box or other structure as will be described below. Aperture 56 in top face 48 and aperture 58 in bottom face 50 can receive a suitable fastener (not shown) to mount body 40 upon a single gang gem box (not shown), upon the adapter plate or other structures as described below.

Figure 2:
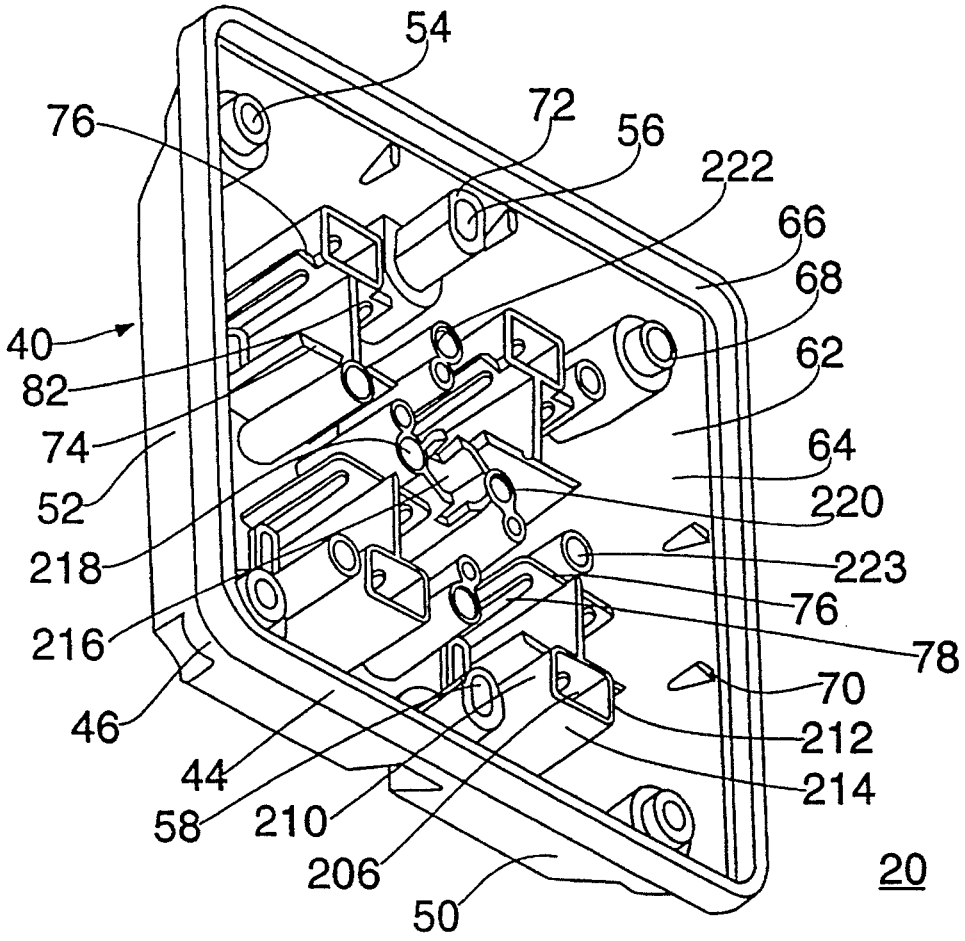
FIG. 2 is an isometric view of the quadriplex receptacle of FIG. 1 viewed from the rear.
Figure 3:
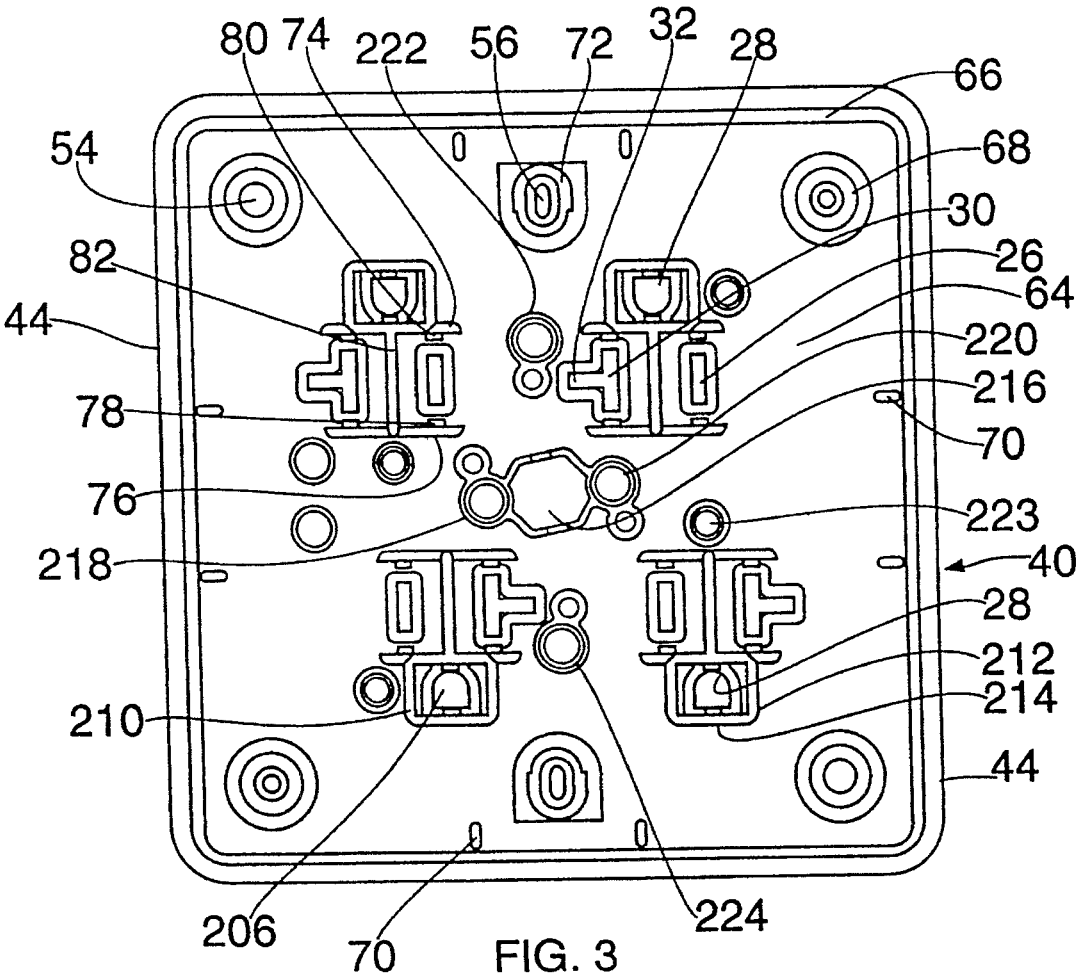
FIG. 3 is rear elevational view of the quadriplex receptacle of FIG. 1.
Figure 3A:
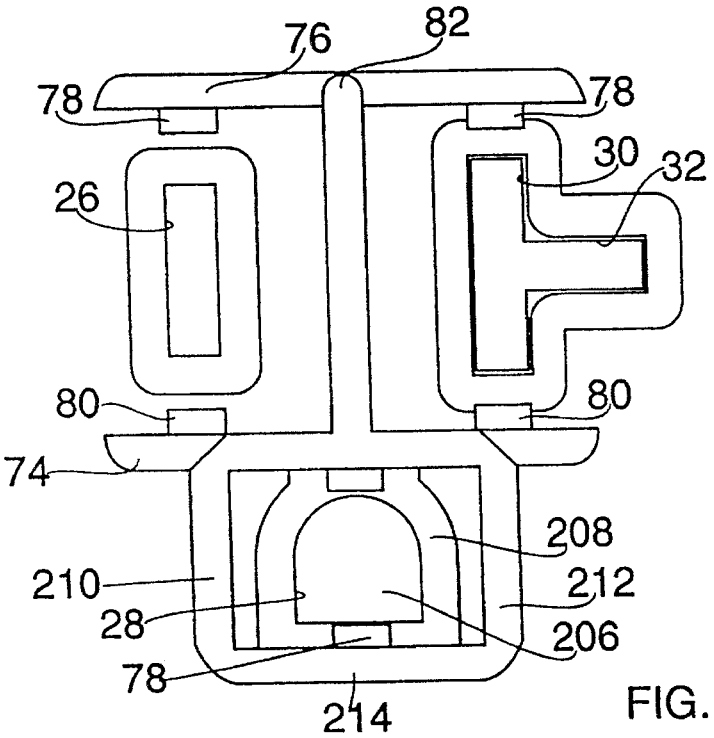
FIG. 3A is an enlargement of one of the plug reception areas of FIG. 3.

Turning now to FIGS. 2, 3 and 3A the various support ribs, bosses and separators within the cavity 64 of body 40 are shown. A recess 66 extends completely about the interior of rib 44 to receive and support the outer periphery of the cover which closes the substantially open rear surface 62 of body 40. A series of ribs 70 adjacent recess 66 support the main body of the cover. Bosses 68 surround the apertures 54 and engage the cover adjacent the apertures 54. Bosses 72 surround apertures 56 and 58 and extend through mating apertures in the cover (not shown). Four sets of dividing walls support the various connecting buses and provide insulation barriers to prevent contact between non-mating components. About the hot, phase or line slot 24 are two parallel, spaced apart walls 74 and 76 and the connecting bus, to be described below, at one side of the contact, rests upon the upper surface of wall 76. Each of the walls 74 and 76 has a rib 78 on its inner surface which is shorter than the height of its associated wall to provide a support surface 80 upon which the other side of a bus leg is placed. A transverse wall 82 connects walls 74 and 76 and is taller than both to provide an insulating barrier between two adjacent buses as will be described below.

Figure 6:
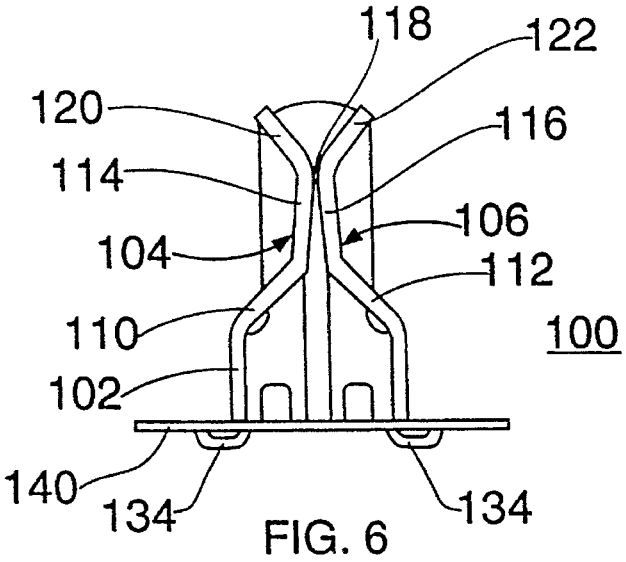
FIG. 6 is a side elevational view of the contracts used for engaging the line and neutral blades of a three blade electrical plug.
Figure 7:
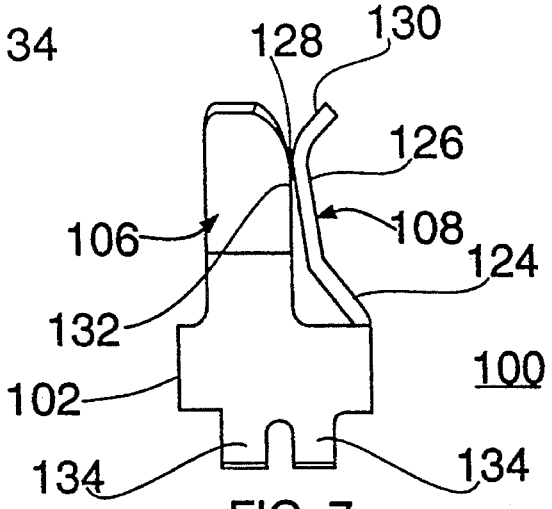
FIG. 7 is a front elevational view of the contacts of FIG. 6.

The contacts 100 employed to engage both the line an neutral plug blades are shown in FIGS. 6 and 7. The contacts 100 have a generally rectangular base 102, open on one side, from which project three arms. All three arms are of the same general shape and the arms 104 and 106 face each other while arm 108 faces one edge of arms 104 and 106. Each of the arms 104, 106 has a first inwardly directed portion 110, 112, respectively, and a further inwardly portion 114, 116, respectively, which meet at a nip 118. The ends 120, 122 of the arms 104, 106, respectively are outwardly directed to guide an inserted plug blade into nip 118 and facilitate separation of arms 104, 106 to seat the plug blade (not shown) between arms 104, 106. The horizontally directed blade of a 20 Amp plug which enters the receptacle 20 through side slot 32 will be seated in the nip 118 to make contact.

The arm 108 also has a first inwardly directed portion 124, a second inwardly directed portion 126 which forms a nip 128 with the edges 132 of arms 104 and 106. The ends 120 and 122 of arms 104 and 106 are rounded adjacent edges 132 to provide a guide for the entry of a blade of a plug into nip 128 and facilitate separation of arm 108 from arms 104, 106 to seat the plug blade (not shown) between arms 104, 106 and 108. The vertically directed blades of the 15 Amp plug and the single vertical blade of a 20 Amp plug will be seated in the nip 128 to make contact. Two tangs 134 extend from the bottom edge of base 102 on each of the two parallel base legs. The tangs 134 extend through apertures 136 in the line bus 140 (see FIG. 5) and are staked to anchor the contacts 100 to the bus.

Figure 5:
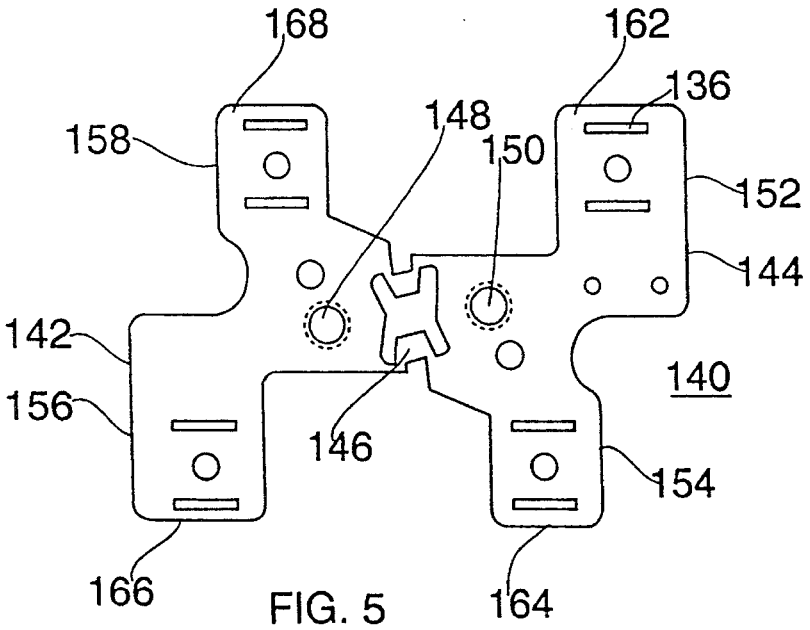
FIG. 5 is a top plan view of the selectively severable line bus of the quadriplex receptacle of FIG. 1.

The hot, phase or line bus 140 is shown in FIG. 5. Bus 140 is made up of two portions 142 and 144 which can be separated from one another by breaking the two links 146 which unite portions 142, 144 mechanically and electrically. With links 146 in place all four receptacles are connected in common with one another. The line conductor (not shown) can be connected to bus 140 by means of a binding head screws 149 or 151 threaded into one of the threaded apertures 148, 150. (see FIG. 13) When links 146 are removed members 152, 154 are common and members 156, 158 are common. One line conductor (not shown) is then connected by binding head screw 151 in threaded aperture 150 to activate members 152, 154 while another line conductor is connected by binding bead screw 149 in threaded aperture 148 to activate member 156, 158.

The outer edges 162, 164, 166 and 168 of members 152, 154, 156 and 158, respectively, will be supported by support surfaces 80 of ribs 78 while the inner surfaces of members 152, 154. 156 and 158 will be supported by the walls 76.

Figure 8:
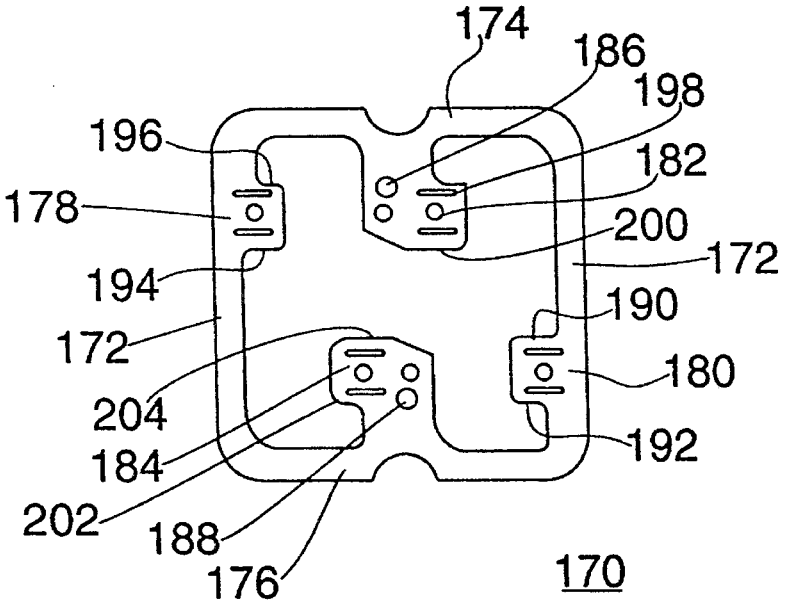
FIG. 8 is a top plan view of the neutral bus of the quadriplex receptacle of FIG. 1.

The bus 170 to which each of the neutral contacts 100 is mounted is shown in FIG. 8. The bus 170 is a generally rectangular ring having two side members 172, a top member 174 and a bottom member 176. Inwardly directed contact engaging members 178, 180 extend from opposite ends of side members 172 into the void within bus 170. Oppositely facing inwardly directed contact engaging members 182 and 184 extend into the central void in bus 170 from top member 174 and bottom member 176, respectively. Threaded binding head screws (not shown) may be placed in threaded aperture 186 in member 182 and 188 in member 184 to permit the neutral bus to be connected to the neutral conductors of one or more electrical cables.

If the quadriplex receptacle 20 is to be used as a junction box for multiple electrical devices, then the line conductor is connected to screw 149 or 151 while the neutral conductor is connected to screw 187 or 189 (see FIG. 13) threaded into threaded apertures 186 and 188. If the quadriplex receptacle 20 is to be used as two duplex receptacles then after links 146 are broken the line and neutral conductors of a first electrical cable will be fastened to screws 151 and 189 and the line and neutral conductors of a second electrical cable will be fastened to screws 149 and 187. To use the quadriplex receptacle 20 to power the four receptacles and pass the electrical cable through for further connection outside of the quadriplex receptacle 20, with the links 146 in place a first cable from a power source is connected with the line and neutral conductors fastened to screws 151 and 189 and a second cable is fastened by screws 149 and 187 and terminated at its opposite end as desired.

The method of supporting the neutral bus 170 is similar to the manner in which the line bus 140 was supported except that the tops of both walls 74 and 76 are used rather than a support surface 80 of a rib 78. Edge 190 of member 180 rests on the top of wall 76 and edge 192 rests on the top of wall 74. Edge 194 of member 178 rests on top of wall 76 while edge 196 rests on top of wall 74. The top of wall 74 supports edge 198 of member 182 and top of wall 76 supports edge 200 of member 182. Edge 202 of member 184 is supported on the top of wall 74 whiled edge 204 rests on the top of wall 76. As stated above, the walls 82 are higher than the walls 74, 76 and are higher than the combined height of such walls and the buses they support to provide an effective insulation barrier between adjacent portions of the line bus 140 and the neutral bus 170.

The cavities 206 to receive the ground contacts at one end and the ground blade at the other are also formed in cavity 64. Aperture 28 has a strengthening rib 208 about its inner surface. From the backside of wall 74 are formed two, parallel, spaced apart walls 210, 212 which join a cross wall 214. Interior strengthening ribs 78 are placed on the inside of cross wall 214 and along the back of wall 74. The height of walls 74 in the regions of cavities 206 is higher than the remaining parts of walls 74 and the heights of the walls 210, 212 and 214 are the same as the height of the central part of wall 74. The walls about the cavities 206 engage edges of the buses 140 and 170 and limit movement of these buses within body 40.

Two hollow columns 218, 220, one to each side of hexagonal recess 216 receive the threaded ends of the screws 149, 151 while recess 216 receives the end of the tool used to remove links 146. The two hollow columns 222, 224 receive the threaded ends of screws 187 and 189 respectively.

Figure 9:
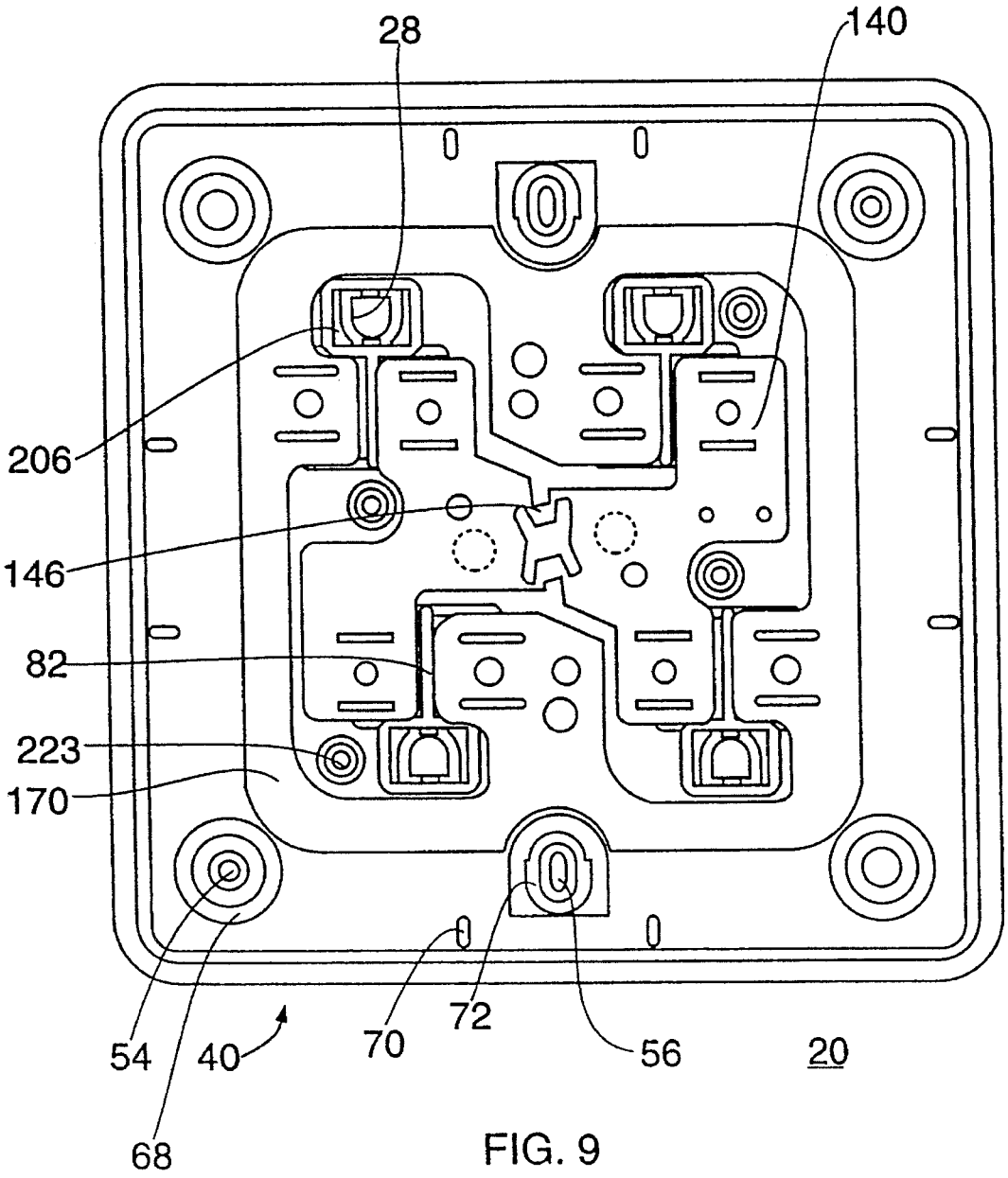
FIG. 9 is a rear elevational view of the body of FIG. 3 with the line bus of FIG. 5 and the neutral bus of FIG. 8 in place.

Turning to FIG. 9 there is shown the quadriplex receptacle 20 body 40 with the line bus 140 and the neutral bus 170 in place. The neutral bus 170 totally surrounds the line bus 140 and is prevented from touching the line bus 140 by the walls 82.

Figure 12:
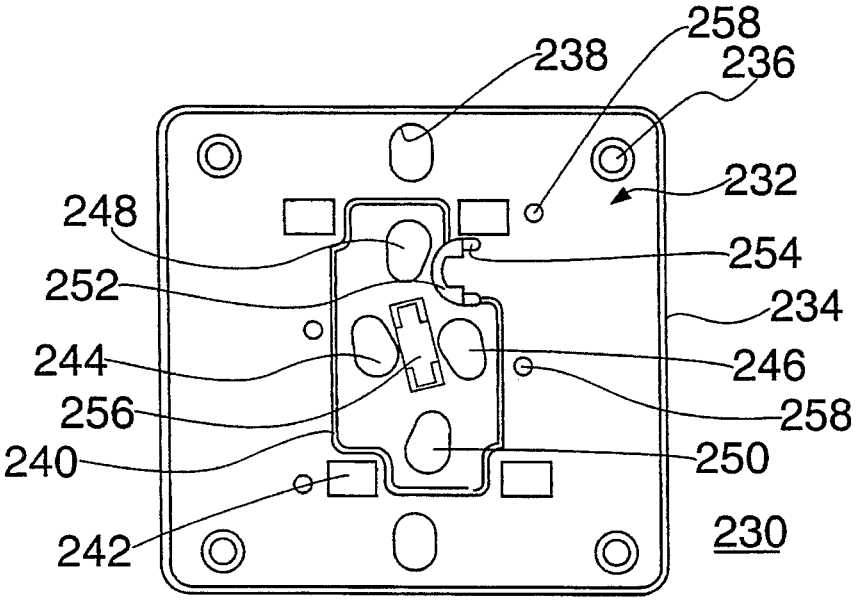
FIG. 12 is a rear plan view of a back cover for the quadriplex receptacle of FIG. 1.

At this point the cover 230, as shown in FIG. 12, can be put over the substantially open back surface 62 to substantially close the entrance to cavity 64. A low wall 234 surrounds the rear surface 232 of cover 230. Four apertures 236, adjacent the comers of cover 230, are arranged to be aligned with apertures 54 in body 40 so that a fastener can pass through receptacle 20. Two elongate apertures 238 are located, one along the top edge, the other along the bottom edge to receive bosses 72. A further low retaining wall 240 has the shape of the void in the ground bus, as will be described below and assists in locating the ground bus and preventing its movement. Four rectangular openings 242 near the corners of wall 240 permit the ground contacts attached to the ground bus to pass through cover 230 and enter the cavities 206. Apertures 244 and 246 provide access to screws 149 and 151, respectively, of the line bus 140 and apertures 248 and 250 provide access to screws 187 and 189, respectively, of the neutral bus 170. A semi-circular wall 252 isolates the terminal screw of the ground bus from the screws 149, 151, 187 and 189 and the conductors attached to them. The entrance 254 to wall 252 is enlarged to receive the lug of the grounding bus as will be described below. A slot 256 in the center of cover 230 provides access to the links 146 of the line bus 140. Four holes 258 permit screws used to fasten the ground bus to the body 40 to pass through cover 230 and threadably engage the mounting posts 223.

Figure 10:
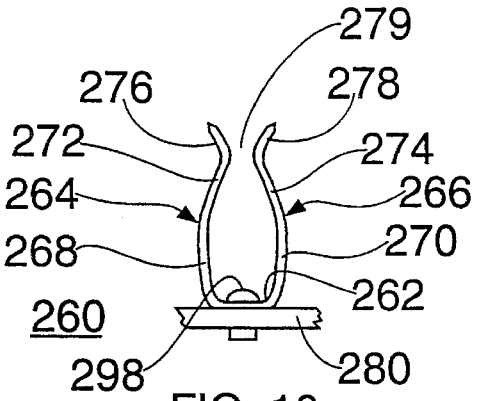
FIG. 10 is a front elevational view of contacts used for engaging the ground blade of a three blade electrical plug.

Turning now to FIG. 10 the ground contacts 260 are shown. Contact 260 has a base 262 which contains an aperture so that contact 260 can be riveted to the ground bus. Two upstanding arms 264 and 266 extend one from each end of base 262. Each of the arms 264, 266 has a first outwardly directed segment 268, 270, respectively, followed by an inwardly directed segment 272, 274, respectively. The ends 276, 278, respectively, of arms 264 and 266 are directed outwardly to provide a lead-in and centering for the ground blade of an inserted plug. The ground blade will be engaged by the arms 264, 266 at their narrow entrance 279 at the junctions between segments 272, 276 and 274, 278, respectively.

Figure 11:
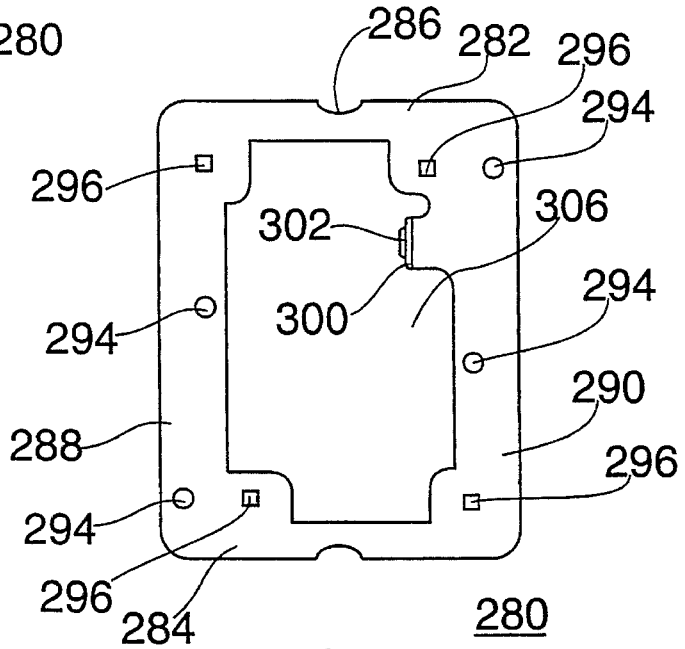
FIG. 11 is a top plan view of the ground bus of the quadriplex receptacle of FIG. 1.

The ground bus 280 is shown in FIG. 11 and is generally rectangular having a top member 282 and bottom member 284 each of which has a semi-circular recess 286 to accept part of the bosses 72. The bus 280 is completed by two side members 288 and 290 which contain apertures 294 to receive assembly screws (not shown). Four further apertures 296 are provided to receive rivets 298 to anchor the ground contacts 260 to the ground bus 280. A lug 300 is struck from side member 290 and bent at 90° to the plane of the ground bus 280. A threaded aperture 302 is place in lug 300 and a binding head screw 304 (see FIG. 13) is made to engage threaded aperture 302. The grounding conductor of the electrical cable is connected to screw 304 to provide an isolated ground which does not depend on the grounding done through the neutral conductor.

The void 306 within members 282, 284, 288 and 290 is the same shape as the low wall 240 and slightly larger so that wall 240 can be received within void 306. Positioned in that location, lug 300 will span entrance 254 to wall 252 while the threaded end of screw 304 fits within the interior of wall 252. The assembly of the ground bus 280 with ground contacts 260 attached brings each of the ground contacts 260 through an aperture 242 in cover 230 into a cavity 206 in body 40 and adjacent aperture 28. The completed assembly of the cover 230, the ground bus 280 and the body 40 viewed from the rear is shown in FIG. 13.

Figure 13:
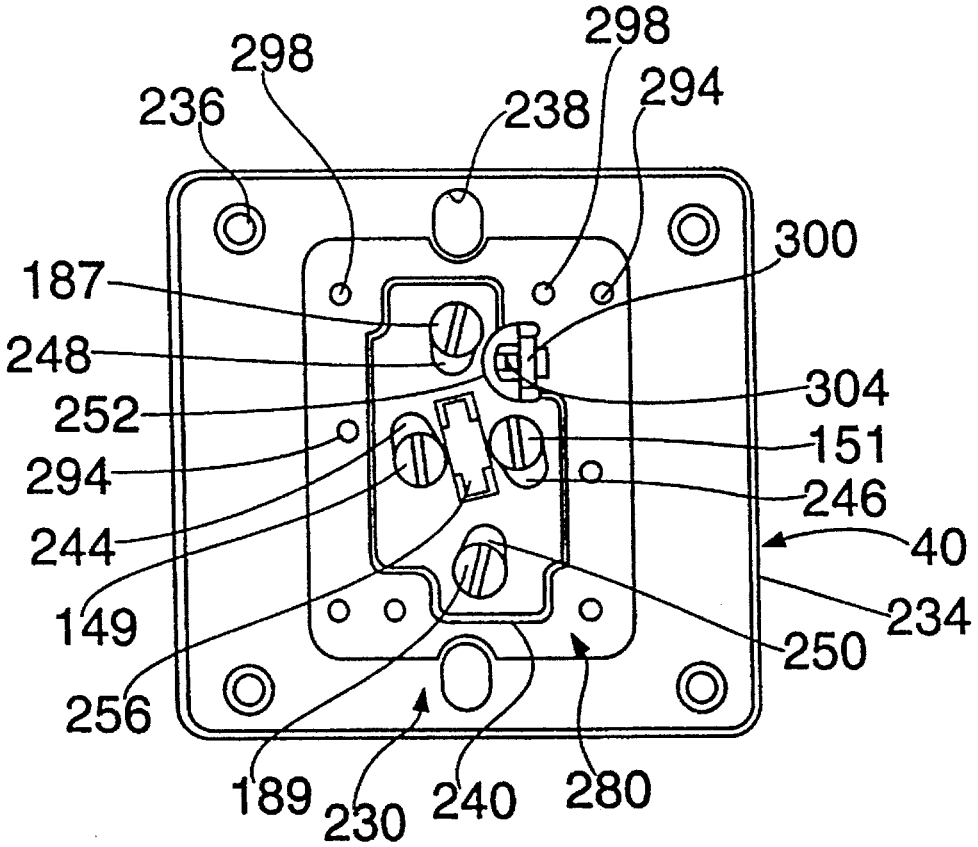
FIG. 13 is a rear elevational view of the quadriplex receptacle of FIG. 1.
Figure 14:
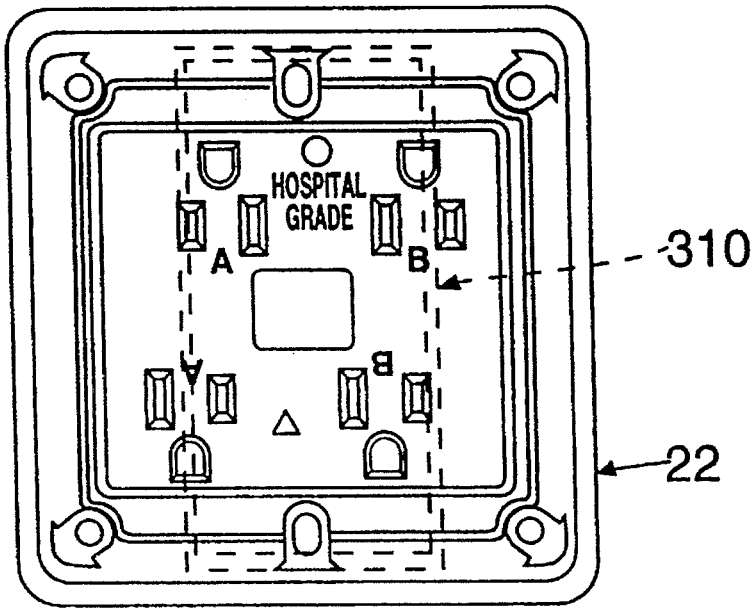
FIG. 14 is a front elevational view of the quadriplex receptacle of FIG. 4 showing in dashed line the outline of a single gang gem outlet box to which the quadriplex receptacle is mounted.

Due to the locations of the screws 149, 151, 187, 189 and 304, as shown in FIG. 13, they can all be placed within the profile of the interior of a standard single gang gem outlet box and the quadriplex receptacle can be supported by such box using the mounting holes provided by the outlet box. On the front view of a quadriplex receptacle 22 as shown in FIG. 14, the approximate location of receptacle 22 with outlet box 310 is shown. The mounting ears of box 310 will appear behind the bosses 72 and fastening screws (not shown) will be passed through apertures 56 and 58 in bosses 72, through apertures 238 in cover 230 and threadedly engage the threaded apertures in the box ears.

Figure 15:
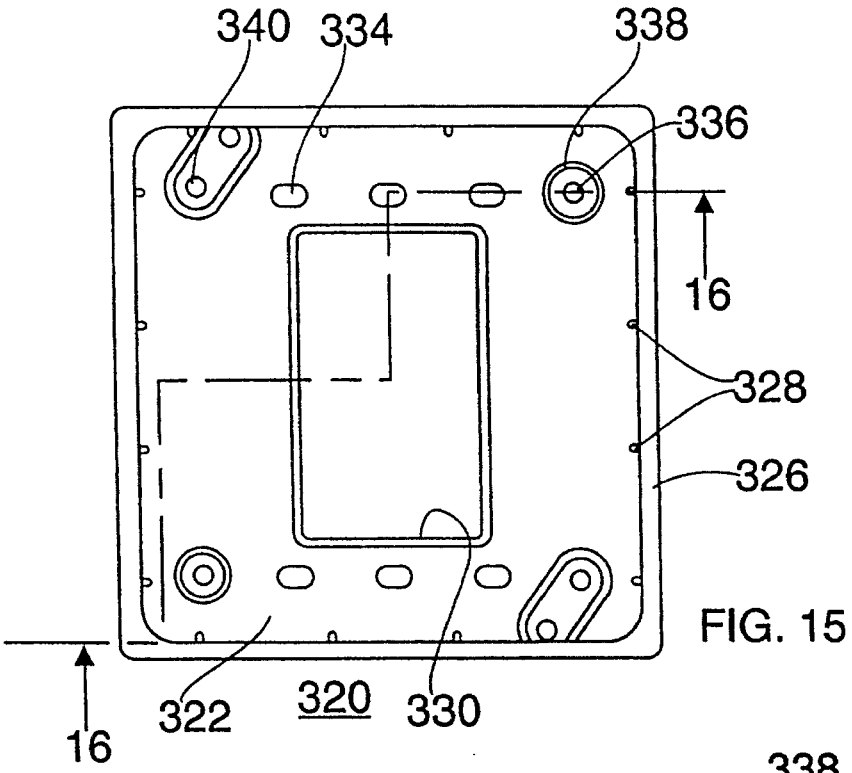
FIG. 15 is a front elevational view of an adapter plate which can be used to secure the quadriplex receptacle to a mounting surface.
Figure 16:
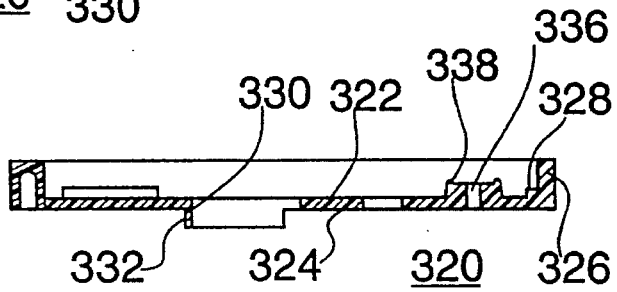
FIG. 16 is a side elevational view, partly in section, of the adapter plate of FIG. 15 taken along the lines 16—16.
Figure 17:
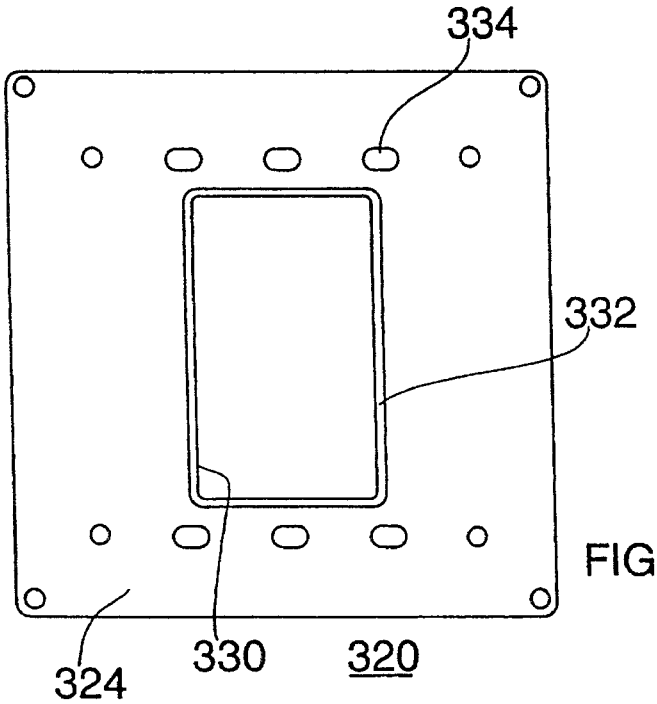
FIG. 17 is a rear elevational view of the adapter plate of FIG. 15.
Figure 18:
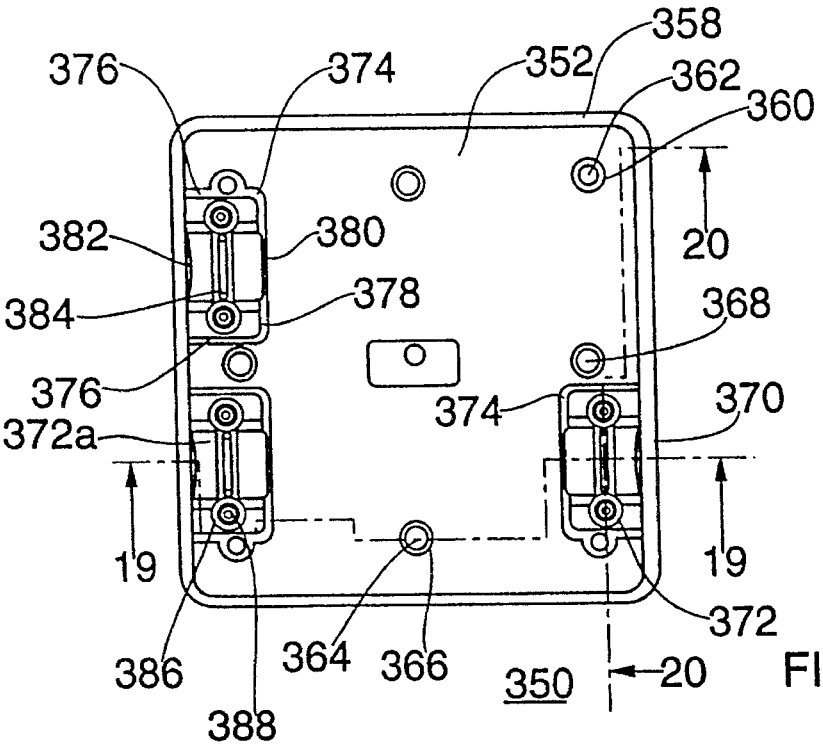
FIG. 18 is a top plan view of the inside of the box for use with the quadriplex receptacle.
Figure 19:
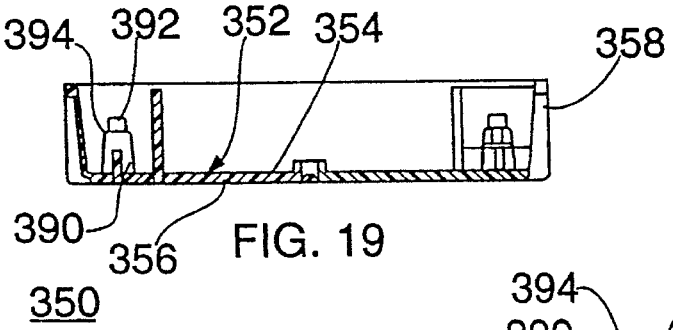
FIG. 19 is a front elevational view, partly in section, of the box of FIG. 18 taken along the lines 19—19.

If desired, the quadriplex receptacles 20, 22 can be mounted to a so-called "4 inch box", directly to a wall or other structural member using an adapter plate 320 as shown in FIGS. 15, 16 and 17. Plate 320 has a generally planar inside surface 322 and a planar outside surface 324. A raised wall 326 extends completely about inside surface 322 with square outside comers and rounded inside comers. The inside profile of wall 326 matches the outside profile of rib 44 so that body 40 seats within wall 326 with rib 44 closely aligned with the inner profile of wall 326. The amount of rib 44 that enters the adapter plate 320 depends upon the position of the limit ribs 328. A central, rectangular opening 330 is surrounded by low wall 332 on outside surface 324. The opening 330 permits the electrical cables (not shown) to be brought to the receptacles for connection thereto. The low wall 332 prevents debris entering the receptacle as when mounted in a plaster or sheet rock wall. A number of elongate apertures 334 are placed along the top and bottom portions of adapter plate 320 to receive mounting screws therethrough to anchor the plate 320 to a wall, for example. The receptacle 20, 22 is then fastened to adapter plate 320 using fasteners (not shown) passed through apertures 54 and 236 into apertures 336 in bosses 338. Additional apertures 340 also can receive fasteners passed through apertures 54 and 236.

To permit use of the quadriplex receptacles 20, 22 as portable devices, a plastic box 350, as shown in FIGS. 18 to 21, can be fitted to the rear of the receptacles 20, 22. The box 350 has a base 352 having a generally flat inside surface 354 and a flat outside surface 356 with a wall 358 extending about the entire inner surface 354. The wall 358 has a height sufficient to provide clearance for lug 300 and for one or more electrical cables to be connected to the receptacles 20, 22. This height may be, for example, ⅞ of an inch. Four columns 360 having holes 362 are arranged on inner surface 354 to be aligned with the apertures 54 and 236. A self-threading fastener (not shown) can be passed through aperture 54 in body 40, aperture 236 in cover 230 and engage the wall of the hole 362 of column 360 to secure receptacle 20, 22 to box 350. To be able to use box 350 as a surface mounted box, four apertures 364 are provided, one centered on each of the four edges of box 350. Each aperture 364 is surrounded by a boss 366 and is covered by a knock-out tab 368. The knock-out tabs 368 are removed using an awl or other similar tool (not shown) and fasteners are positioned in the apertures 364.

An electrical cable entry 370 is provided in wall 358 and adjacent cable entry 370 is placed a strain relief 372. A wall 374 surrounds the cable entry 370 having two parallel spaced apart end sections 376 and a central section 378. A portion of central section 378 is removed to provide a raised curved step 380. A similar raised, curved step 382 is formed adjacent the juncture of wall 358 with inside surface 354. Centered between raised, curved steps 380 and 382 is a similar raised, curved step 384. Formed at each end of step 384 is a column 386 having a boss 388 therein. Column 386 has a lower portion of a first diameter 390 and a second upper portion 392 of a lesser diameter providing a step 394.

Figure 21:
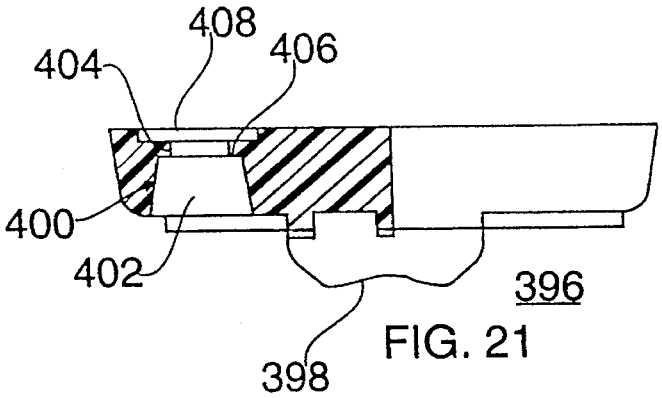
FIG. 21 is an enlarged side elevational view of the movable member of the strain relief, partly in section.

The entire inside of the region bounded by the wall 374 is covered by member 396. The bottom surface of member 396, as shown in FIG. 21 has two centrally located raised curved steps 398 (only one is visible in FIG. 21) which are respectively, centered in the space on inside surface 354 between steps 380 and 384 and the space between steps 384 and 382. At the ends of member 396 are bores 400 having a first potion 402 of a first diameter and a second portion 404 of a lesser diameter and providing step 406 between them. When member 396 is positioned on column 386, lower portion 390 is in bore section 402 and upper portion 392 is in bore section 404. Step 406 is in contact with step 394. This is the condition with no cable in the strain relief 372. Depending upon the thickness of the electrical cable placed in the strain relief 372, the relative positions of the bore 400 with respect to the column 386 changes. A counterbore 408 accepts the head of a fastener (not shown) used to control the spacing between steps 380, 382 and 384 on inner surface 354 and the steps 398 on member 396. The fastener, a self-taping screw, (not shown) engages the wall about bore 388 in column 386 and controls the spacing between the member 396 and the steps 380, 382 and 384.

After an electrical cable (not shown) has been passed through cable entry 370 and through strain relief 372 and its conductors attached to the proper bus, and some slack provided in the cable in the box 350, the movable grip member 396 is made to grip the electrical cable within the walled portion 374. Because of the steps 380, 382 and 384 on inside surface 354 and the steps 398 on the member 396 the electrical cable is securely grasped. Based upon the thickness and stiffness of the electrical cable, the cable may be made to undulate in the strain relief 372 improving the grip on the cable.

Figure 20:
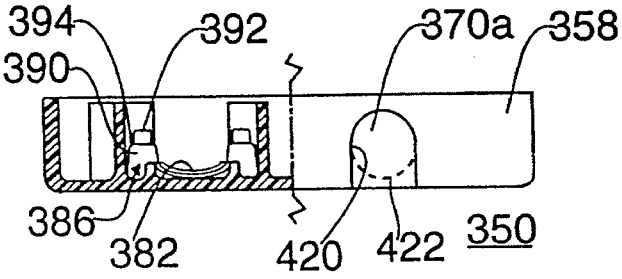
FIG. 20 is a side elevational view, partly in section, of the box of FIG. 18 taken along the lines 20—20.

If it is desired to have two duplex receptacles in the box 350, a second cable entry **370*a* and second strain relief 372*a* are used. As shown in FIG. 20 the wall 358 has a recess 420 and a portion of the back wall 422 of such recess 420 can be punched out to give a circular cable entry 370*a*. A strain relief 372*a* is provided adjacent cable entry 370*a***. There are a total of three possible cable entries each with its own strain relief. Only one is provided without a plug and the other two have removable knock-out plugs. Two cable entries are required where the electrical cable feeding the quadriplex receptacle is also passed through the receptacle for further connection to other components.

If it is desired to make contact with the buses outside of the box, conductors can be attached to the buses and brought out cable entry 370 to be used as pigtails which would not require disassembly of the box 350.

While there have been shown and described and pointed out the fundamental novel features of the invention as applied to the preferred embodiments, it will be understood that various omissions and substitutions and changes of the form and details of the devices illustrated and in theft operation may be made by those skilled in the art, without departing from the spirit of the invention.

The embodiments of the invention in which an exclusive property or privilege is claimed are defined as follows:

1. An electrical apparatus having at least two electrical receptacles therein comprising:

a) body means having a central longitudinal axis and having a first generally closed surface, a second generally open surface, spaced apart from and generally parallel with said first surface; a cavity extending inwardly from said second surface towards said first surface and a plurality of first apertures extending from said cavity through said body means to said first surface;

b) at least two first contacts, one for each of said at least two electrical receptacles, each of said at least two first contacts positioned adjacent a first aperture of said at least two receptacles to receive and retain a first blade of a three blade electrical plug inserted through an associated first aperture into each of said at least two first contacts;

c) line bus means coupled to each of said at least two first contacts and positioned inside said body cavity, said line bus means selectively separable into two separate line bus means each associated with a different one of said at least two first contacts;

d) at least two second contacts, one for each of said at least two electrical receptacles, each of said at least two second contacts positioned adjacent a different first aperture of said at least two receptacles to receive and retain a second blade of a three blade electrical plug inserted through said associated different first aperture into each of said at least two second contacts;

e) neutral bus means coupled to each of said at least two second contacts and positioned inside said body cavity;

f) at least two third contacts, one for each of said at least two electrical receptacles, each of said at least two third contacts positioned adjacent a further first aperture to receive and retain a third blade of a three blade electrical plug inserted through said associated further first aperture into each of said at least two third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said at least two third contacts and positioned over said cover means with said at least two third contacts extending through associated second apertures into said cavity and adjacent associated first apertures;

i) a first plurality of ribs in said cavity to support said line bus means either as one line bus means or two separate line bus means; and j) a second plurality of ribs in said cavity to support said neutral bus means in said cavity completely encircling said line bus means and electrically insulated therefrom.

2. An electrical apparatus as defined in claim 1, further comprising:

a) two first terminal means coupled to said line bus means one for each of said two separable line bus means; and b) at least one second terminal means coupled to said neutral bus means.

3. An electrical apparatus having at least two electrical receptacles therein comprising:

a) body means having a central longitudinal axis and having a first generally closed surface, a second generally open surface, spaced apart from and generally parallel with said first surface; a cavity extending inwardly from said second surface towards said first surface and a plurality of first apertures extending from said cavity through said body means to said first surface;

b) at least two first contacts, one for each of said at least two electrical receptacles, each of said at least two first contacts positioned adjacent a first aperture of said at least two receptacles to receive and retain a first blade of a three blade electrical plug inserted through an associated first aperture into each of said at least two first contacts;

c) line bus means coupled to each of said at least two first contacts and positioned inside said body cavity, said line bus means selectively separable into two separate line bus means each associated with a different one of said at least two first contacts;

d) at least two second contacts, one for each of said at least two electrical receptacles, each of said at least two second contacts positioned adjacent a different first aperture of said at least two receptacles to receive and retain a second blade of a three blade electrical plug inserted through said associated different first aperture into each of said at least two second contacts;

e) neutral bus means coupled to each of said at least two second contacts and positioned inside said body cavity;

f) at least two third contacts, one for each of said at least two electrical receptacles, each of said at least two third contacts positioned adjacent a further first aperture to receive and retain a third blade of a three blade electrical plug inserted through said associated further first aperture into each of said at least two third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said at least two third contacts and positioned over said cover means with said at least two third contacts extending through associated second apertures into said cavity and adjacent associated first apertures;

i) two first terminal means coupled to said line bus means, one for each of said two separable line bus means; and j) two second terminal means coupled to said neutral bus means;

k) whereby, when said line bus means is separated into two separate line bus means, one of said first terminal means and one of said second terminal means can receive the line and neutral conductors, respectively, of a first electrical cable and the second of said first terminal means and the second of said second terminal means can receive the line and neutral conductors, respectively, of a second electrical cable to provide two independent electrical receptacles.

4. An electrical apparatus as defined in claim 3, further comprising:

a) adapter means having a front surface and a rear surface and bounded by a top edge, a bottom edge and two marginal edges;

b) a central aperture in said adapter means from said front surface to said rear surface to permit said first and second electrical cables to pass therethrough;

c) a plurality of first mounting apertures in said adapter means to receive first fasteners therethrough to permit said adapter means to be fastened to a support surface; and d) a plurality of second mounting apertures in said adapter means to receive second fasteners therein to fasten said body means to said adapter means.

5. An electrical apparatus as defined in claim 4, further comprising:

a) first assembly means to fasten said cover means to said body means;

b) a plurality of third apertures extending through said body means from said first surface into said cavity; and c) a plurality of fourth apertures extending though said cover means and aligned with said first mounting apertures in said adapter means and an associated one of said third apertures, whereby fastening means can be passed through said third, fourth and first mounting apertures to fix said apparatus to a support structure.

6. An electrical apparatus having at least two electrical receptacles, therein comprising:

a) body means having a central longitudinal axis and having a first generally closed surface, a second generally open surface, spaced apart from and generally parallel with said first surface; a cavity extending inwardly from said second surface towards said first surface and a plurality of first apertures extending from said cavity through said body means to said first surface;

b) at least two first contacts, one for each of said at least two electrical receptacles, each of said at least two first contacts positioned adjacent a first aperture of said at least two receptacles to receive and retain a first blade of a three blade electrical plug inserted through an associated first aperture into each of said at least two first contacts;

c) line bus means coupled to each of said at least two first contacts and positioned inside said body cavity, said line bus means selectively separable into two separate line bus means each associated with a different one of said at least two first contacts;

d) at least two second contacts, one for each of said at least two electrical receptacles, each of said at least two second contacts positioned adjacent a different first aperture of said at least two receptacles to receive and retain a second blade of a three blade electrical plug inserted through said associated different first aperture into each of said at least two second contacts;

e) neutral bus means coupled to each of said at least two second contacts and positioned inside said body cavity;

f) at least two third contacts, one for each of said at least two electrical receptacles, each of said at least two third contacts positioned adjacent a further first aperture to receive and retain a third blade of a three blade electrical plug inserted through said associated further first aperture into each of said at least two third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said at least two third contacts and positioned over said cover means with said at least two third contacts extending through associated second apertures into said cavity and adjacent associated first apertures;

i) first assembly means to fasten said cover means to said body means;

i) a plurality of third apertures extending through said body means from said first surface into said cavity; and k) a plurality of fourth apertures extending through said cover means, each of said fourth apertures aligned with an associated one of said third apertures, whereby fastening means can be passed through said third and fourth to fix said apparatus to a support structure.

7. An electrical apparatus as defined in claim 6, further comprising:

a) two first terminal means coupled to said line bus means, one for each of said two separable line bus means, said two first terminal means positioned adjacent the central longitudinal axis of said body means; and b) two second terminal means coupled to said neutral bus means, said two second terminal means positioned adjacent the central longitudinal axis of said body means and separated from each other and said first terminal means;

c) said two first terminal means and said two second terminal means fitting within a standard gang electrical box having two mounting ears, each mounting ear having a mounting aperture therein when said apparatus is mounted to such box by fastening means passed through said third and fourth apertures into the mounting apertures of such box.

8. An electrical apparatus having at least two electrical receptacles therein comprising:

a) body means having a central longitudinal axis and having a first generally closed surface, a second generally open surface, spaced apart from and generally parallel with said first surface; a cavity extending inwardly from said second surface towards said first surface and a plurality of first apertures extending from said cavity through said body means to said first surface;

b) at least two first contacts, one for each of said at least two electrical receptacles, each of said at least two first contacts positioned adjacent a first aperture of said at least two receptacles to receive and retain a first blade of a three blade electrical plug inserted through an associated first aperture into each of said at least two first contacts;

c) line bus means coupled to each of said at least two first contacts and positioned inside said body cavity, said line bus means selectively separable into two separate line bus means each associated with a different one of said at least two first contacts;

d) at least two second contacts, one for each of said at least two electrical receptacles, each of said at least two second contacts positioned adjacent a different first aperture of said at least two receptacles to receive and retain a second blade of a three blade electrical plug inserted through said associated different first aperture into each of said at least two second contacts;

e) neutral bus means coupled to each of said at least two second contacts and positioned inside said body cavity;

f) at least two third contacts, one for each of said at least two electrical receptacles, each of said at least two third contacts positioned adjacent a further first aperture to receive and retain a third blade of a three blade electrical plug inserted through said associated further first aperture into each of said at least two third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said at least two third contacts and positioned over said cover means with said at least two third contacts extending through associated second apertures into said cavity and adjacent associated first apertures;

i) box means for attachment to said body means to enclose said cover means and said ground bus means, said box means having an inside surface and an outside surface generally parallel to each other, a top edge, a bottom edge and two marginal edges;

j) a continuous side wall perpendicular to said inside surface and extending along said top edge, said bottom edge and said two marginal edges to describe a five-sided box means open adjacent the free edge of said continuous side wall remote from said inside surface, said box means being closed when said box means is attached to said body means.

9. An electrical apparatus as defined in claim 8, wherein said side wall has at least one aperture therethrough to receive an electrical cable therein;

a) at least one strain relief device, one for each of said at least one aperture, positioned adjacent its associated aperture; and b) at least one adjustable clamping means, one for each of said at least one strain relief device, positioned adjacent its associated strain relief device for clamping an electrical cable passed through said at least one aperture between said inside surface of said box means and said associated at least one strain relief device.

10. An electrical apparatus as defined in claim 9, further comprising: at least one raised rib on said inside surface of said box means opposite each of said at least one strain relief device to provide a tortuous path for the electrical cable passed through said at least one aperture to better hold such cable.

11. An electrical apparatus as defined in claim 9, wherein said side wall has at least one additional aperture therethrough to receive an electrical cable therein whereby a first electrical cable can be made to enter said box means through one of said at least one aperture and a second electrical cable made to exit said box means through one of said at least one additional apertures in a first arrangement and a single electrical cable can pass through said box means by entering through one of said at least one additional aperture in a second arrangement.

12. An electrical apparatus as defined in claim 11, further comprising:

a) at least one additional strain relief device, one for each of said at least one additional aperture, positioned adjacent its associated additional aperture; and b) at least one additional adjustable clamping means, one for each of said at least one additional strain relief device, positioned adjacent its associated additional strain relief device for clamping an electrical cable passed through said at least one additional aperture between said inside surface of said box means and said associated at least one additional strain relief device.

13. An electrical apparatus as defined in claim 12, further comprising: at least one additional raised rib on said inside surface of said box means opposite each of said at least one additional strain relief device to provide a tortuous path for the electrical cable passed through said at least one additional aperture to better hold such cable.

14. An electrical apparatus having four electrical receptacles therein comprising:

a) a body means having a central longitudinal axis and a first generally closed surface, a second generally open surface, spaced apart from and generally parallel with said first surface; a cavity extending inwardly from said second surface towards said first surface and a plurality of first apertures extending from said cavity through said body means to said first surface;

b) four first contacts, one for each of said four electrical receptacles, each of said four first contacts positioned adjacent a first aperture of each of said four electrical receptacles to receive and retain a first blade of a three blade electrical plug inserted through an associated first aperture into each of said four first contacts;

c) line bus means coupled to each of said four first contacts and positioned inside said body cavity; said line bus means being selectively separable into two separate line bus means, each associated with two different ones of said first contacts to provide two duplex receptacles;

d) four second contacts, one for each of said four second contacts positioned adjacent a different first aperture of each of said four electrical receptacles to receive and retain a second blade of a three blade electrical plug inserted through an associated different first aperture into each of said four second contacts;

e) neutral bus means coupled to each of said four second contacts and positioned inside of said body cavity;

f) four third contacts, one for each of said four electrical receptacles, each of four third contacts positioned adjacent a further first aperture of each of said four electrical receptacles to receive and retain a third blade of a three blade electrical plug inserted through an associated further first aperture into each of said four third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said four third contacts and positioned over said cover means with said four third contacts extending through associated second apertures into said cavity and adjacent associated further first apertures;

i) a first plurality of ribs in said cavity to support said line bus means either as one line bus means or two separate line bus means and to isolate said bus means from other structures in said cavity; and j) a second plurality of ribs in said cavity to support said neutral bus means in said cavity completely encircling said line bus means and electrically insulated therefrom.

15. An electrical apparatus as defined in claim 14, further comprising:

a) two first terminal means coupled to said line bus means, one for each of said two separable line bus means; and b at least one second terminal means coupled to said neutral bus means.

16. An electrical apparatus having four electrical receptacles therein comprising:

a) body means having a central longitudinal axis and a first generally closed surface, a second generally open surface, spaced apart from and generally parallel with said first surface; a cavity extending inwardly from said second surface towards said first surface and a plurality of first apertures extending from said cavity through said body means to said first surface;

b) four first contacts, one for each of said four electrical receptacles, each of said four first contacts positioned adjacent a first aperture of each of said four electrical receptacles to receive and retain a first blade of a three blade electrical plug inserted through an associated first aperture into each of said four first contacts;

c) line bus means coupled to each of said four first contacts and positioned inside said body cavity; said line bus means being selectively separable into two separate line bus means, each associated with two different ones of said first contacts to provide two duplex receptacles;

d) four second contacts, one for each of said four second contacts positioned adjacent a different first aperture of each of said four electrical receptacles to receive and retain a second blade of a three blade electrical plug inserted through an associated different first aperture into each of said four second contacts;

e) neutral bus means coupled to each of said four second contacts and positioned inside of said body cavity;

f) four third contacts, one for each of said four electrical receptacles, each of four third contacts positioned adjacent a further first aperture of each of said four electrical receptacles to receive and retain a third blade of a three blade electrical plug inserted through an associated further first aperture into each of said four third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said four third contacts and positioned over said cover means with said four third contacts extending through associated second apertures into said cavity and adjacent associated further first apertures;

i) two first terminal means coupled to said line bus means, one for each of said two separable line bus means; and j) two second terminal means coupled to said neutral bus means;

k) whereby, when said line bus means is separated into two separate line bus means, one of said first terminal means and one of said second terminal means can receive the line and neutral conductors, respectively, of a first electrical cable and the second of said first terminal means and the second of said second terminal means can receive the line and neutral conductors, respectively, of a second electrical cable to provide two duplex receptacles.

17. An electrical apparatus as defined in claim 16, further comprising:

a) adapter means having a front surface and a rear surface and bounded by a top edge, a bottom edge and two marginal edges;

b) a central aperture in said adapter means froth said front surface to said rear surface to permit said first and second electrical cables to pass therethrough;

c) a plurality of first mounting apertures in said adapter means to receive first fasteners therethrough to permit said adapter means to be fastened to a support surface; and d) a plurality of second mounting apertures in said adapter means to receive second fasteners therethrough to fasten said body means to said adapter means.

18. An electrical apparatus as defined in claim 17, further comprising:

a) first assembly means to fasten said cover means to said body means;

b) a plurality of third apertures extending through said body means from said first surface into said cavity; and c) a plurality of fourth apertures extending though said cover means and aligned with said first mounting apertures in said adapter means and an associated one of said third apertures, whereby fastening means can be passed through said third, fourth and first mounting apertures to fix said apparatus to a support structure.

19. An electrical apparatus having four electrical receptacles therein comprising:

a) body means having a central longitudinal axis and a first generally closed surface, a second generally open surface, spaced apart from and generally parallel with said first surface; a cavity extending inwardly from said second surface towards said first surface and a plurality of first apertures extending from said cavity through said body means to said first surface;

b) four first contacts, one for each of said four electrical receptacles, each of said four first contacts positioned adjacent a first aperture of each of said four electrical receptacles to receive and retain a first blade of a three blade electrical plug inserted through an associated first aperture into each of said four first contacts;

c) line bus means coupled to each of said four first contacts and positioned inside said body cavity; said line bus means being selectively separable into two separate line bus means, each associated with two different ones of said first contacts to provide two duplex receptacles;

d) four second contacts, one for each of said four second contacts positioned adjacent a different first aperture of each of said four electrical receptacles to receive and retain a second blade of a three blade electrical plug inserted through an associated different first aperture into each of said four second contacts;

e) neutral bus means coupled to each of said four second contacts and positioned inside of said body cavity;

f) four third contacts, one for each of said four electrical receptacles, each of four third contacts positioned adjacent a further first aperture of each of said four electrical receptacles to receive and retain a third blade of a three blade electrical plug inserted through an associated further first aperture into each of said four third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said four third contacts and positioned over said cover means with said four third contacts extending through associated second apertures into said cavity and adjacent associated further first apertures;

i) first assembly means to fasten said cover means to said body means;

j) a plurality of third apertures extending through said body means from said first surface into said cavity; and k) a plurality of fourth apertures extending through said cover means, each of said fourth apertures aligned with an associated one of said third apertures, whereby fastening means can be passed through said third and fourth apertures to fix said apparatus to a support structure.

20. An electrical apparatus as defined in claim 19, further comprising:

a) two first terminal means coupled to said line bus means, one for each of said two separable line bus means, said two first terminal means positioned adjacent the central longitudinal axis of said body means; and b) two second terminal means coupled to said neutral bus means, said two second terminal means positioned adjacent the central longitudinal axis of said body means and separated from each other and said first terminal means;

c) said two first terminal means and said two second terminal means fitting within a standard gang gem outlet electrical box having two mounting ears, each of said two mounting ears having a mounting aperture therein when said apparatus is mounted to such box by fastening means passed through said third and fourth apertures into the mounting apertures of such box.

21. An electrical apparatus having four electrical receptacles therein comprising:

a) a body means having a central longitudinal axis and a first generally closed surface, a second generally open surface, spaced apart from and generally parallel with said first surface; a cavity extending inwardly from said second surface towards said first surface and a plurality of first apertures extending from said cavity through said body means to said first surface;

b) four first contacts, one for each of said four electrical receptacles, each of said four first contacts positioned adjacent a first aperture of each of said four electrical receptacles to receive and retain a first blade of a three blade electrical plug inserted through an associated first aperture into each of said four first contacts;

c) line bus means coupled to each of said four first contacts and positioned inside said body cavity; said line bus means being selectively separable into two separate line bus means, each associated with two different ones of said first contacts to provide two duplex receptacles;

d) four second contacts, one for each of said four second contacts positioned adjacent a different first aperture of each of said four electrical receptacles to receive and retain a second blade of a three blade electrical plug inserted through an associated different first aperture into each of said four second contacts;

e) neutral bus means coupled to each of said four second contacts and positioned inside of said body cavity;

f) four third contacts, one for each of said four electrical receptacles, each of four third contacts positioned adjacent a further first aperture of each of said four electrical receptacles to receive and retain a third blade of a three blade electrical plug inserted through an associated further first aperture into each of said four third contacts;

g) cover means positionable over said body means second surface and attachable to said body means to generally close said second surface; a plurality of second apertures extending through said cover means into said cavity and aligned with associated first apertures in said body means;

h) ground bus means coupled to each of said four third contacts and positioned over said cover means with said four third contacts extending through associated second apertures into said cavity and adjacent associated further first apertures;

i) box means for attachment to said body means to enclose said cover means and said ground bus means, said box means having an inside surface and an outside surface generally parallel to each other, a top edge, a bottom edge and two marginal edges;

j) a continuous side wall perpendicular to said inside surface and extending along said top edge, said bottom edge and said two marginal edges to describe a five-sided box open adjacent the free edge of said continuous side wall remote from said inside surface, said box means being closed when said box means is attached to said body means.

22. An electrical apparatus as defined in claim 21, wherein said side wall has at least one aperture therethrough to receive an electrical cable therein;

a) at least one strain relief device, one for each of said at least one aperture, positioned adjacent its associated aperture; and b) at least one adjustable clamping means, one for each of said at least one strain relief device, positioned adjacent its associated strain relief device for clamping an electrical cable passed through said at least one aperture between said inside surface of said box means and said associated at least one strain relief device.

23. An electrical apparatus as defined in claim 22, further comprising: at least one raised rib on said inside surface of said box opposite each of said at least one strain relief device to provide a tortuous path for the electrical cable passed through said at least one aperture to better hold such cable.

24. An electrical apparatus as defined in claim 22, wherein said side wall has at least one additional aperture therethrough to receive an electrical cable therein whereby a first electrical cable can be made to enter said box means through one of said at least one aperture and a second electrical cable made to exit said box means through one of said at least one additional apertures in a first arrangement and a single electrical cable can pass through said box means by entering through one of said at least one additional aperture in a second arrangement.

25. An electrical apparatus as defined in claim 24, further comprising:

a) at least one additional strain relief device, one for each of said at least one additional aperture, positioned adjacent its associated additional aperture; and b) at least one additional adjustable clamping means, one for each of said at least one additional strain relief device, positioned adjacent its associated additional strain relief device for clamping an electrical cable passed through said at least one additional aperture between said inside surface of said box means and said associated at least one additional strain relief device.

26. An electrical apparatus as defined in claim 25, further comprising: at least one additional raised rib on said inside surface of said box means opposite each of said at least one additional strain relief device to provide a tortuous path for the electrical cable passed through said at least one additional aperture to better hold such cable.

* * * * *

UNITED STATES PATENT AND TRADEMARK OFFICE

CERTIFICATE OF CORRECTION

PATENT NO. : 5,601,455

DATED : February 11, 1997

INVENTOR(S) : Bagga

It is certified that error appears in the above-identified patent and that said Letters Patent is hereby corrected as shown below:

On the title page, Item [73], Assignee: Leviton Manufacturing Co., Inc.
Little Neck, N.Y.

Signed and Sealed this

Twenty-fourth Day of March, 1998

*Attest:*

Bruce Lehman

BRUCE LEHMAN

*Attesting Officer*

*Commissioner of Patents and Trademarks*